US007624824B2

(12) United States Patent
Hall et al.

(10) Patent No.: US 7,624,824 B2
(45) Date of Patent: Dec. 1, 2009

(54) DOWNHOLE HAMMER ASSEMBLY

(76) Inventors: David R. Hall, 2185 S. Larsen Parkway, Provo, UT (US) 84606; John Bailey, 2185 S. Larsen Parkway, Provo, UT (US) 84606; Scott Dahlgren, 2185 S. Larsen Parkway, Provo, UT (US) 84606

( * ) Notice: Subject to any disclaimer, the term of this patent is extended or adjusted under 35 U.S.C. 154(b) by 156 days.

(21) Appl. No.: 12/037,682

(22) Filed: Feb. 26, 2008

(65) Prior Publication Data

US 2008/0156541 A1 Jul. 3, 2008

Related U.S. Application Data

(63) Continuation-in-part of application No. 12/019,782, filed on Jan. 25, 2008, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/037,682, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, which is a continuation-in-part of application No. 11/306,976, filed on Jan. 18, 2006, which is a continuation-in-part of application No. 11/306,307, filed on Dec. 22, 2005, which is a continuation-in-part of application No. 11/306,022, filed on Dec. 14, 2005, which is a continuation-in-part of application No. 11/164,391, filed on Nov. 21, 2005.

(51) Int. Cl.
*E21B 10/26* (2006.01)
*E21B 10/40* (2006.01)

(52) U.S. Cl. ..... 175/389; 175/415

(58) Field of Classification Search ..... 175/389, 175/385, 415
See application file for complete search history.

(56) References Cited

U.S. PATENT DOCUMENTS 1,372,257 A * 3/1921 Swisher ..... 175/381

(Continued)

*Primary Examiner*—Hoang Dang
(74) *Attorney, Agent, or Firm*—Tyson J. Wilde

(57) ABSTRACT

A drill bit assembly comprises a bit body intermediate a shank and a working face. The shank is adapted for connection to a drill string. The drill string comprising a fluid passage at least partially disposed within the body. A hammer assembly is movably disposed within the fluid passage along it central axis, the hammer assembly comprises a proximal end stabilized by a centralized upper bearing and a distal end stabilized by centralized a lower bearing. The distal end protrudes out of the working face and the hammer assembly comprises a carrier between the upper and lower bearings. Wherein, under normal drilling operations the carrier is adapted to resist a fluid pressure within the fluid passageway such that the fluid pressure will further extend the distal end of the hammer assembly from the working face by pushing on the carrier.

20 Claims, 7 Drawing Sheets

U.S. PATENT DOCUMENTS 1,746,455 A * 2/1930 Woodruff et al. ..... 175/298
2,054,255 A * 9/1936 Howard ..... 175/298
3,303,899 A * 2/1967 Jones, Jr. et al. ..... 175/299
3,336,988 A * 8/1967 Jones, Jr. ..... 173/133
6,131,675 A * 10/2000 Anderson ..... 175/268
2003/0213621 A1 * 11/2003 Britten et al. ..... 175/404

* cited by examiner

DOWNHOLE HAMMER ASSEMBLY

CROSS REFERENCE TO RELATED APPLICATIONS

This Patent Application is a continuation-in-part of U.S. patent application Ser. No. 12/019,782 filed Jan. 25, 2008 which is a continuation-in-part of U.S. patent application Ser. No. 11/837,321 filed Aug. 10, 2007 now U.S. Pat. No. 7,559,379 which is a continuation-in-part of U.S. patent application Ser. No. 11/750,700 filed May 18, 2007 now U.S. Pat. No. 7,549,489. U.S. patent application Ser. No. 11/750,700 is a continuation-in-part of U.S. patent application Ser. No. 11/737,034 filed Apr. 18, 2007 now U.S. Pat. No. 7,503,405. U.S. patent application Ser. No. 11/737,034 is a continuation-in-part of U.S. patent application Ser. No. 11/686,638 filed Mar. 15, 2007 now U.S. Pat. No. 7,424,922. U.S. patent application Ser. No. 11/686,638 is a continuation-in-part of U.S. patent application Ser. No. 11/680,997 filed Mar. 1, 2007 now U.S. Pat. No. 7,419,016. U.S. patent application Ser. No. 11/680,997 is a continuation-in-part of U.S. patent application Ser. No. 11/673,872 filed Feb. 12, 2007 now U.S. Pat. No. 7,484,576. U.S. patent application Ser. No. 11/673,872 is a continuation-in-part of U.S. patent application Ser. No. 11/611,310 filed Dec. 15, 2006 now U.S. Pat. No. 7,600,586. This patent application is also a continuation-in-part of U.S. patent application Ser. No. 11/278,935 filed Apr. 6, 2006 now U.S. Pat. No. 7,426,968. U.S. patent application Ser. No. 11/278,935 is a continuation-in-part of U.S. patent application Ser. No. 11/277,394 filed Mar. 24, 2006 now U.S. Pat. No. 7,398,837. U.S. patent application Ser. No. 11/277,394 filed Mar. 24, 2006 is a continuation-in-part of U.S. patent application Ser. No. 11/277,380 filed Mar. 24, 2006. U.S. patent application Ser. No. 11/277,380 is a continuation-in-part of U.S. patent application Ser. No. 11/306,976 filed Jan. 18, 2006. U.S. patent application Ser. No. 11/306,976 is a continuation-in-part of Ser. No. 11/306,307 filed Dec. 22, 2005. U.S. patent application Ser. No. 11/306,307 is a continuation-in-part of U.S. patent application Ser. No. 11/306,022 filed Dec. 14, 2005. U.S. patent application Ser. No. 11/306,022 is a continuation-in-part of U.S. patent application Ser. No. 11/164,391 filed Nov. 21, 2005. All of these applications are herein incorporated by reference in their entirety.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit can be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottom hole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drill string, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A drill bit assembly comprises a bit body intermediate a shank and a working face. The shank is adapted for connection to a drill string. The drill string comprising a fluid passage at least partially disposed within the body. A hammer assembly is movably disposed within the fluid passage along its central axis, the hammer assembly comprises a proximal end stabilized by a centralized upper bearing and a distal end stabilized by a centralized lower bearing. The distal end protrudes out of the working face and the hammer assembly comprises a carrier between the upper and lower bearings. Wherein, under normal drilling operations the carrier is adapted to resist a fluid pressure within the fluid passageway such that the fluid pressure will further extend the distal end of the hammer assembly from the working face by pushing on the carrier.

The lower bearing may extend from the working face to a biasing element. The upper and/or lower bearing may comprise a material selected from the group consisting of a cemented metal carbide, diamond, cubic boron nitride, nitride, chrome, titanium and combinations thereof. A sealing element may be intermediate the fluid passage and the carrier. The carrier may be in contact with a spring. The spring may be a tension or compression spring. The carrier may comprise a bore adapted to receive a portion of the spring. The carrier may also comprise a fluid relief port. The carrier may also in part form a knife valve. A compression spring may be in contact with an undercut of the hammer assembly. The distal end may comprise an asymmetric tip. The knife valve may be in part formed by a diameter restriction in the fluid passageway. The restriction may comprise a tapered surface adapted to direct fluid flow towards a center of the fluid passage. The restriction may also comprise an undercut. The hammer assembly may comprise a 0.1 to 0.75 inch stroke.

In another aspect of the invention a drill bit assembly comprises a bit body intermediate a shank and a working face. The shank is adapted for connection to a drill string. The drill string comprises a fluid passage at least partially disposed within the body. A hammer assembly is movably disposed within the fluid passage along its central axis. The hammer assembly comprises a distal end protruding out of the working face and a carrier, and the hammer assembly further comprises a biasing element adapted to urge the distal end of the hammer assembly towards the shank.

The biasing element may be a spring. The biasing element may comprise a segmented spring. The segmented spring may comprise intertwined segments. The biasing element may be in contact with an undercut of the hammer assembly. The biasing element may also be intermediate the undercut and a bottom of the fluid passage. The body of the drill bit may comprise at least one centralized bearing adapted to stabilize the hammer. The distal end may comprise a substantially pointed tip adapted to engage a formation. The drill bit may comprise an upper and lower bearing around the hammer assembly. The bearings may be disposed near proximal and distal ends of the hammer. The biasing element may be a tension spring engaged with the carrier of the hammer assembly. The biasing element may be a tension spring engaged with the carrier of the hammer assembly. The knife valve may be in part formed by a diameter restriction in the fluid passageway. The restriction may comprise a tapered surface adapted to direct fluid flow towards a center of the fluid passage. The restriction may comprise an undercut. The hammer assembly may be 5 to 20 lbs.

In another aspect of the invention a drill bit assembly comprises a bit body intermediate a shank and a working face. The shank is adapted for connection to a drill string. The drill string comprises a fluid passage at least partially disposed within the body. A valve is adapted to obstruct at least a portion of a fluid flow within the fluid passage; and the valve comprises a first plurality of ports formed in a moveable carrier adapted to vertically align and misalign with a second plurality of ports formed in an annular structure surrounding the carrier.

The valve may comprise a first plurality annular ports adapted to vertically align and misalign with a second plurality of ports formed in an annular structure surrounding the carrier. The valve may comprise a spring adapted to align and misalign the first ports with the second ports. The first ports may comprise an electrical component adapted for movement. The first and second ports may be tapered.

DETAILED DESCRIPTION OF THE INVENTION AND THE PREFERRED EMBODIMENT

Figure 1:
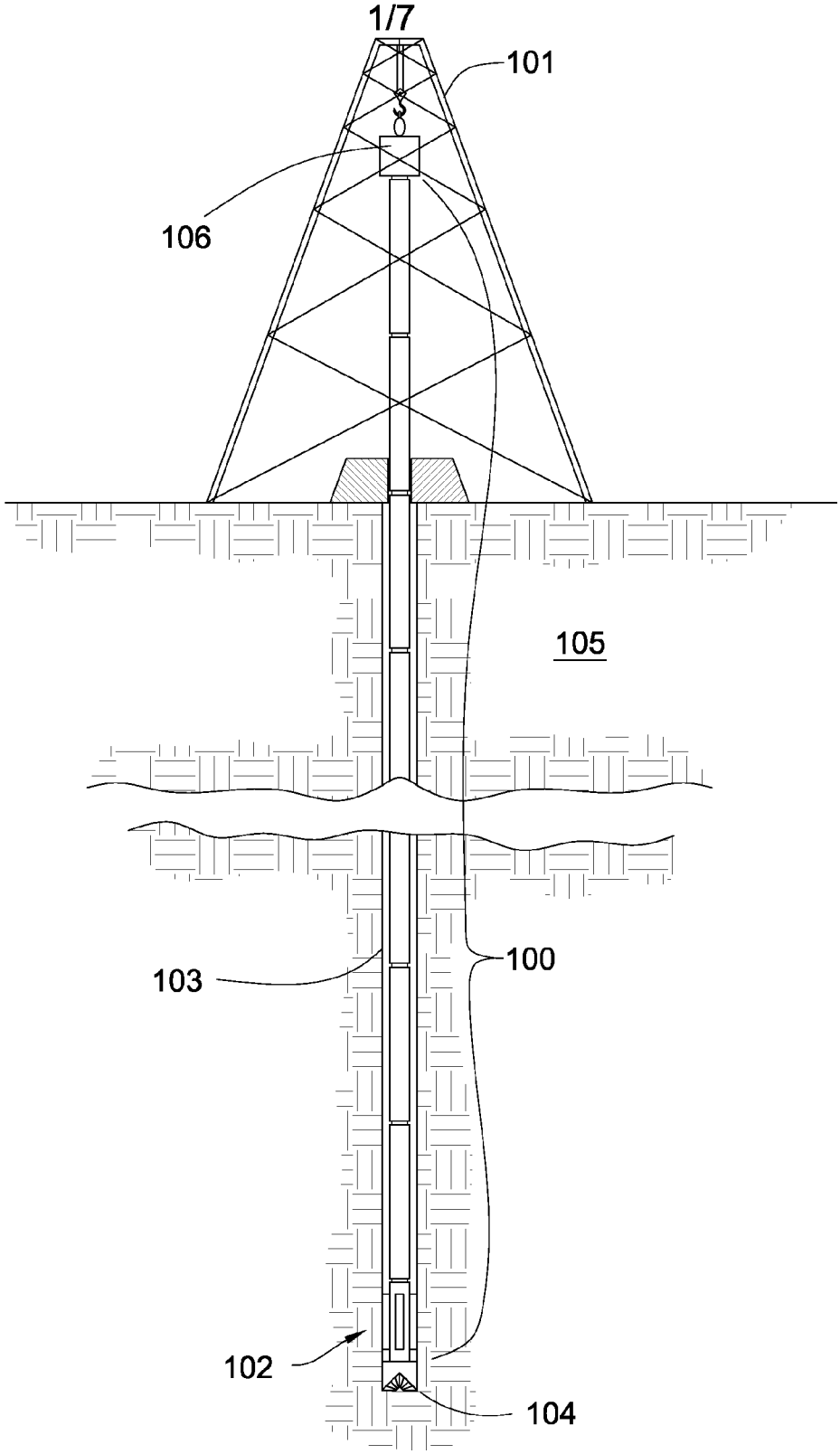
FIG. 1 is a perspective diagram of an embodiment of a drill string suspended in a bore hole.

FIG. 1 is a cross-sectional diagram of an embodiment of a drill string 100 suspended by a derrick 101. A bottom hole assembly 102 is located at the bottom of a bore hole 103 and comprises a drill bit 104. As the drill bit 104 rotates downhole the drill string 100 advances farther into the earth. The drill string 100 may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. In some embodiments of the present invention there is no electrical transmission system.

Figure 2:
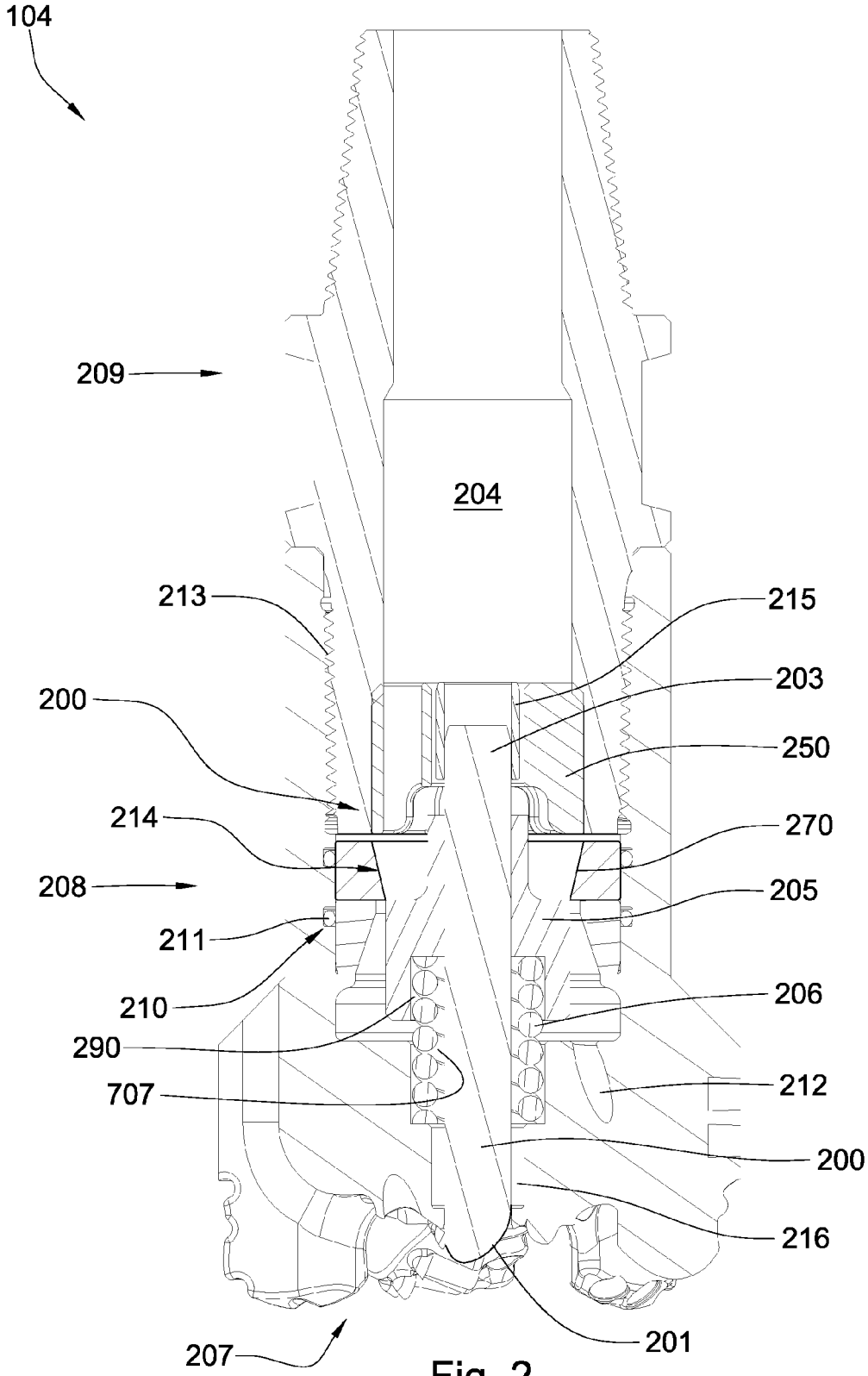
FIG. 2 is a cross-sectional diagram of an embodiment of a drill bit.

FIG. 2 is a cross-sectional diagram of an embodiment of a drill bit 104. The drill bit 104 may comprise a bit body 208 intermediate a shank 209 and a working face 207. The bit body 208 may comprise a threaded form adapted for attachment to the shank 209. The drill bit 104 may comprise a portion of a fluid passage 204 that extends the length of the drill string 100. The fluid passage 204 may comprise a centralizer 250 with an upper bearing 215 disposed around a proximal end 203 of a hammer assembly. The fluid passage 204 may be in communication with a carrier 205 of the hammer assembly. The hammer assembly may weigh 5 to 20 lbs. The carrier 205 may be disposed around the hammer 200 as well. The fluid passing through the fluid passage 204 may contact a fluid engaging surface of the carrier 205 forcing the hammer 200 to extend from the working face. The carrier 205 may also comprise a bore 290 adapted to receive a biasing element 206. The fluid passage 204 may comprise an inward taper 270 as it approaches the carrier 205. The taper 270 may also comprise an undercut adapted to increase the fluid flow area underneath it. The undercut may be formed in the same material as the inward taper or it may be formed in by an insert. A fluid may travel through the fluid passage and through a centralizer 250 contacting the hammer assembly at the carrier 205, and may exit through the working face 207. The fluid contacting the carrier 205 may cause the carrier to move axially downward moving the hammer 200 toward a formation. As the hammer assembly moves, the fluid engaging surface may pass the inward taper such that the fluid pressure is relieved as the area for fluid flow increases. This drop in pressure in conjunction with an opposing force from the biasing element may return the hammer assembly to its original position thus moving the fluid engaging surface above the inward taper and reducing the fluid flow area such that the fluid pressure on the hammer increases again causing the cycle to repeat itself. This may cause an oscillating of the hammer assembly. The biasing element 206 may be a segmented spring disposed around the hammer 200. The biasing element 206 may be disposed within a chamber 707 of the drill bit 104. The segments of the spring may be intertwined or they could be stacked upon one another. It is believed that an oscillating hammer assembly 200 may aid the drill bit 104 in drilling into formations. The upper bearing 215 and a lower bearing 216 may restrict the hammer 200 to oscillate in a linear direction. The upper 215 and lower bearings 216 may comprise carbide, hardened steel, chromium, titanium, ceramics, or combinations thereof. This may aid in preventing wear to the bearings and to the hammer 200. The hammer 200 may comprise an asymmetric tip 550 which may aid in steering the bit.

Figure 3:
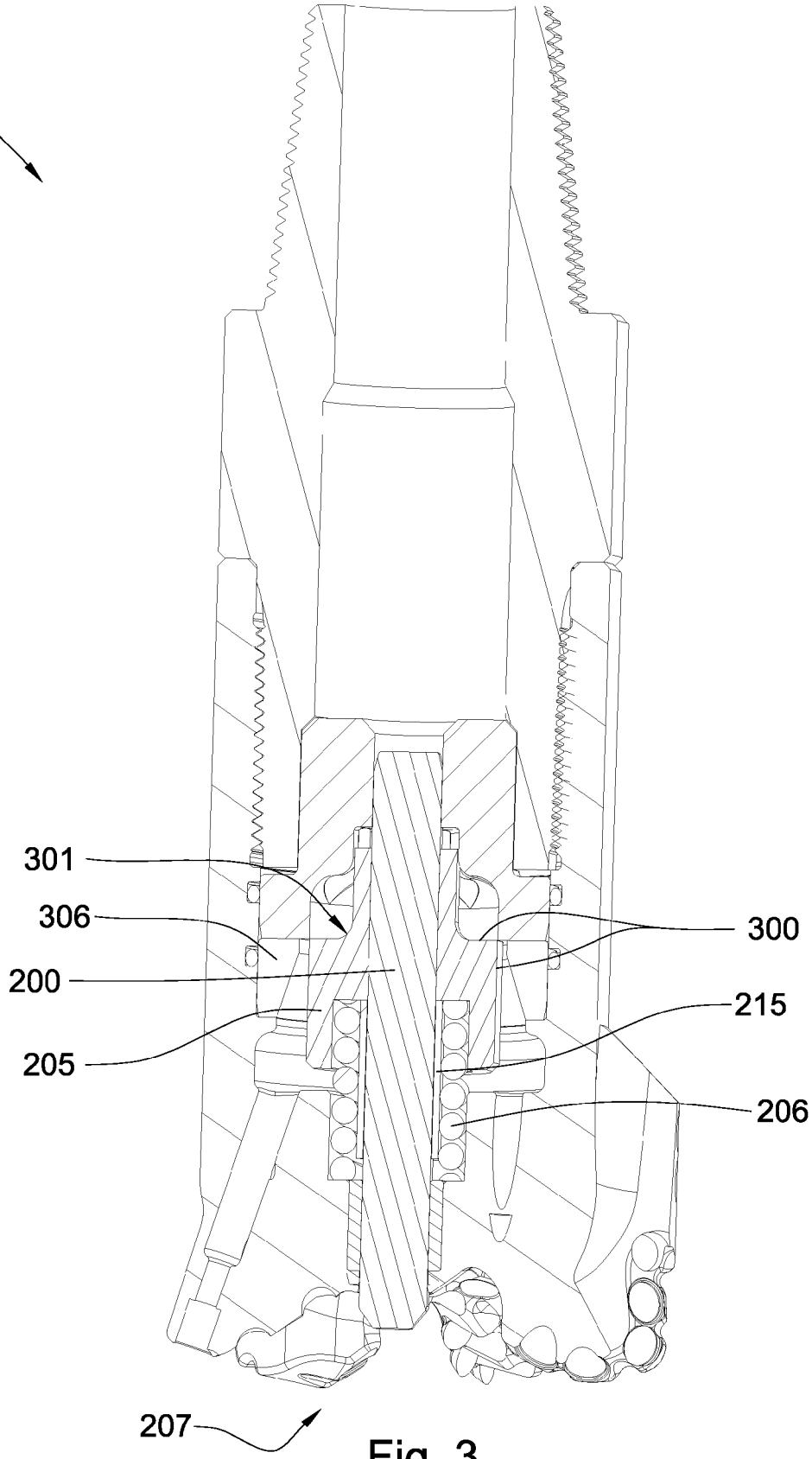
FIG. 3 is another cross-sectional diagram of an embodiment of a drill bit.

FIG. 3 is a cross-sectional diagram of another embodiment of a drill bit 104. The drill bit 104 may comprise a fluid passage 204 in communication with the carrier 205. A fluid may pass directly to the carrier 205 and may cause the carrier 205 to move. The carrier 205 may be in communication with a biasing element 206 which may oppose pressure of the fluid. The carrier 205 may axially move up and down. The carrier 205 may be in communication with a hammer 200. The hammer 200 may oscillate with the carrier 205. The carrier 205 may also comprise flats 300 substantially perpendicular and parallel to the hammer 200. The carrier 205 may comprise a complimentary geometry to that of the fluid passage 204 with a fillet 301 adapted to fit into the fluid passage. The fluid passage 204 may comprise an outward taper 306 toward the working face 207. The drill bit 104 may also comprise a single bearing 215 surrounded by the biasing element 206.

Figure 4:
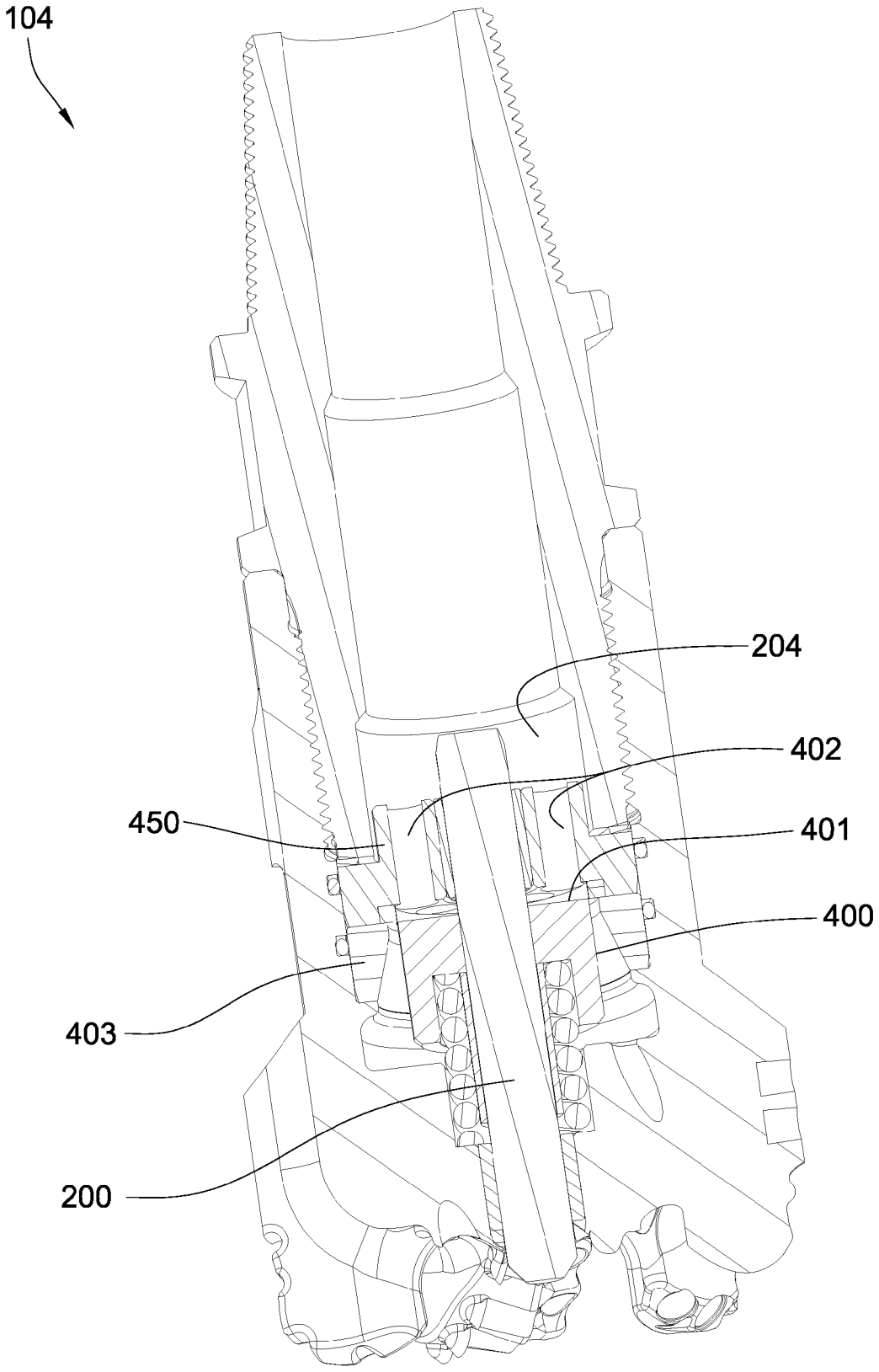
FIG. 4 is another cross-sectional diagram of an embodiment of a drill bit.

FIG. 4 is another cross-sectional diagram of another embodiment of a drill bit 104. The carrier 205 may comprise a first flat 401 perpendicular to the hammer 200 and a second flat 400 parallel to the hammer 200. The carrier 205 may be in contact with the fluid passage 204 through a plurality of ports 402 within a centralizing element 450. The fluid passage 204 may comprise a segmented distal end 403 disposed around the carrier 205.

Figure 5:
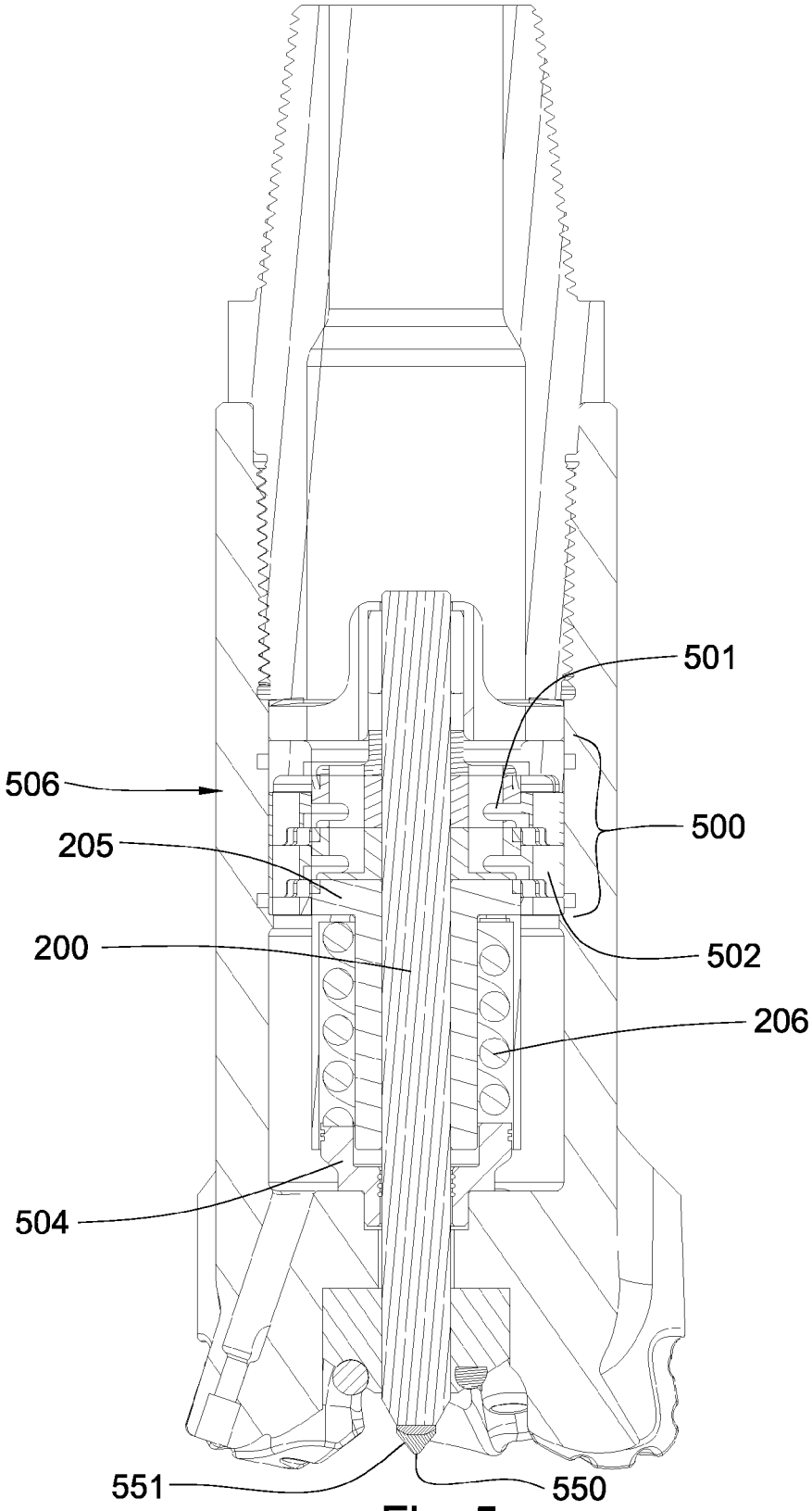
FIG. 5 is another cross-sectional diagram of an embodiment of a drill bit.

FIG. 5 is another cross-sectional diagram of another embodiment of a drill bit 104. The drill bit 104 may comprise a valve 500 that may be adapted to obstruct at least a portion of a fluid flow within the fluid passage 204. The valve 500 may comprise a first plurality of ports 501 formed in the bit body 208 adapted to vertically align and misalign with a second plurality of ports 502 formed in an annular structure 506 surrounding the carrier 205. In another embodiment the second plurality of ports 502 may be variable such that they may move in and out of contact with the first plurality of ports 501. The biasing element 206 may be attached to a first and second carrier 205 at both ends of the biasing element 206. The hammer 200 may comprise a symmetric tip 550. The tip may comprise a diamond working surface 551. The diamond working surface may aid in preventing wear to the hammer.

Figure 6:
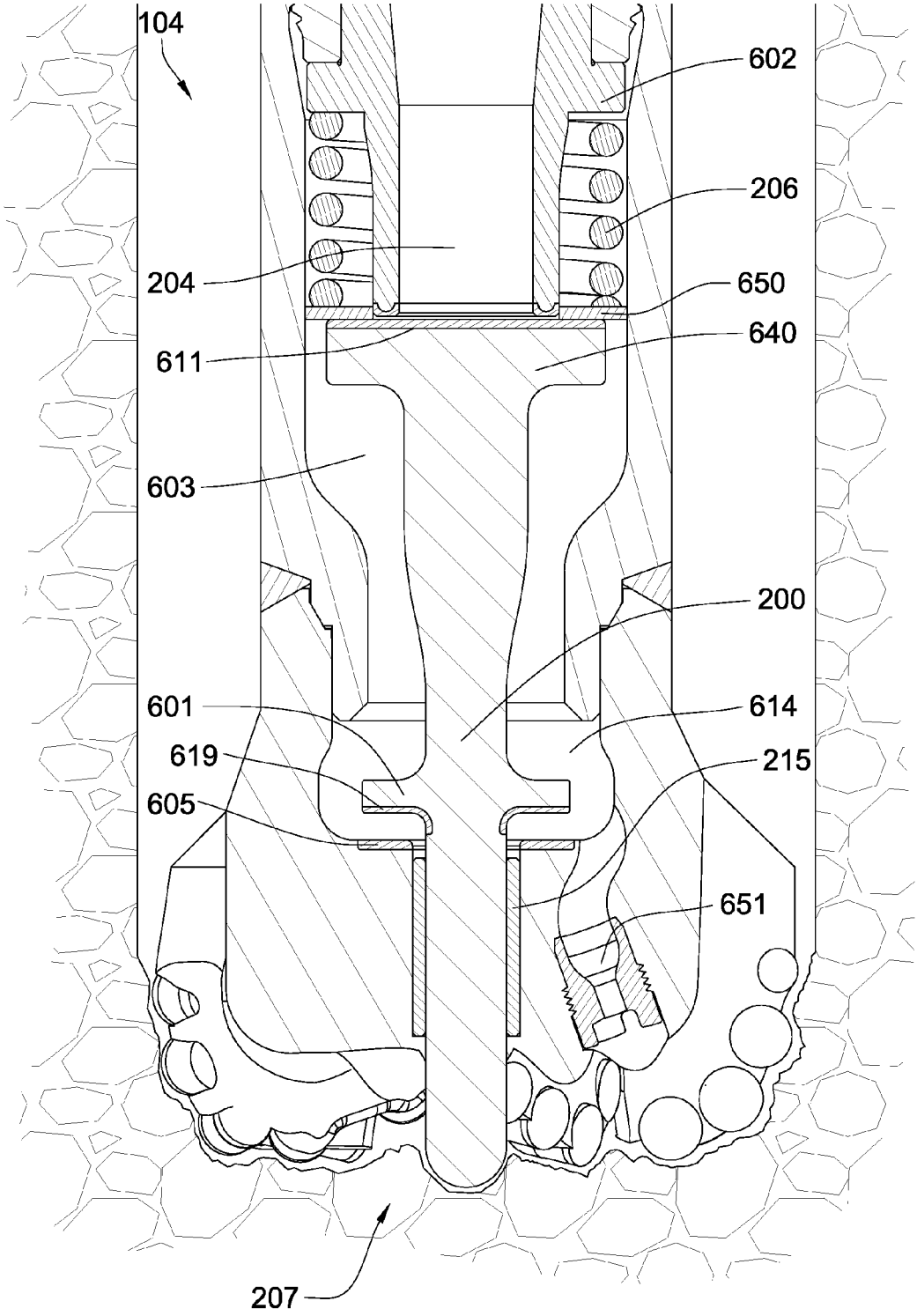
FIG. 6 is another cross-sectional diagram of an embodiment of a drill bit.

FIG. 6 is another cross-sectional diagram of an embodiment of a drill bit 104. This embodiment may contain a biasing element 206 that engages the hammer 200. A second near-sealing surface 611 may comprise a washer 650 with a surface of at least 58 HRc that inhibits fluid communication with the biasing element 206. The second near-sealing surface 611 of the hammer 200 may have a hardness of at least 58 HRc and may be bonded to an undercut 640. A first near-sealing surface 619 may contact the second near-sealing surface 611 of the hammer 200. The first near-sealing surface 619 may comprise a material of at least 58 HRc. The hammer 200 may also have a second seat 601 that may contact a first seat 605 to limit the displacement of the hammer 200. The first seat 605 and the second seat 212 may comprise a material of at least 58 HRc. The hammer 200 may be laterally supported by a bearing 215 comprising a material of at least 58 HRc. The drill bit 104 may also contain a nozzle 651 disposed within a opening 614 to control the fluid flow that may exit the working face 207 of the drill bit 104.

Figure 7:
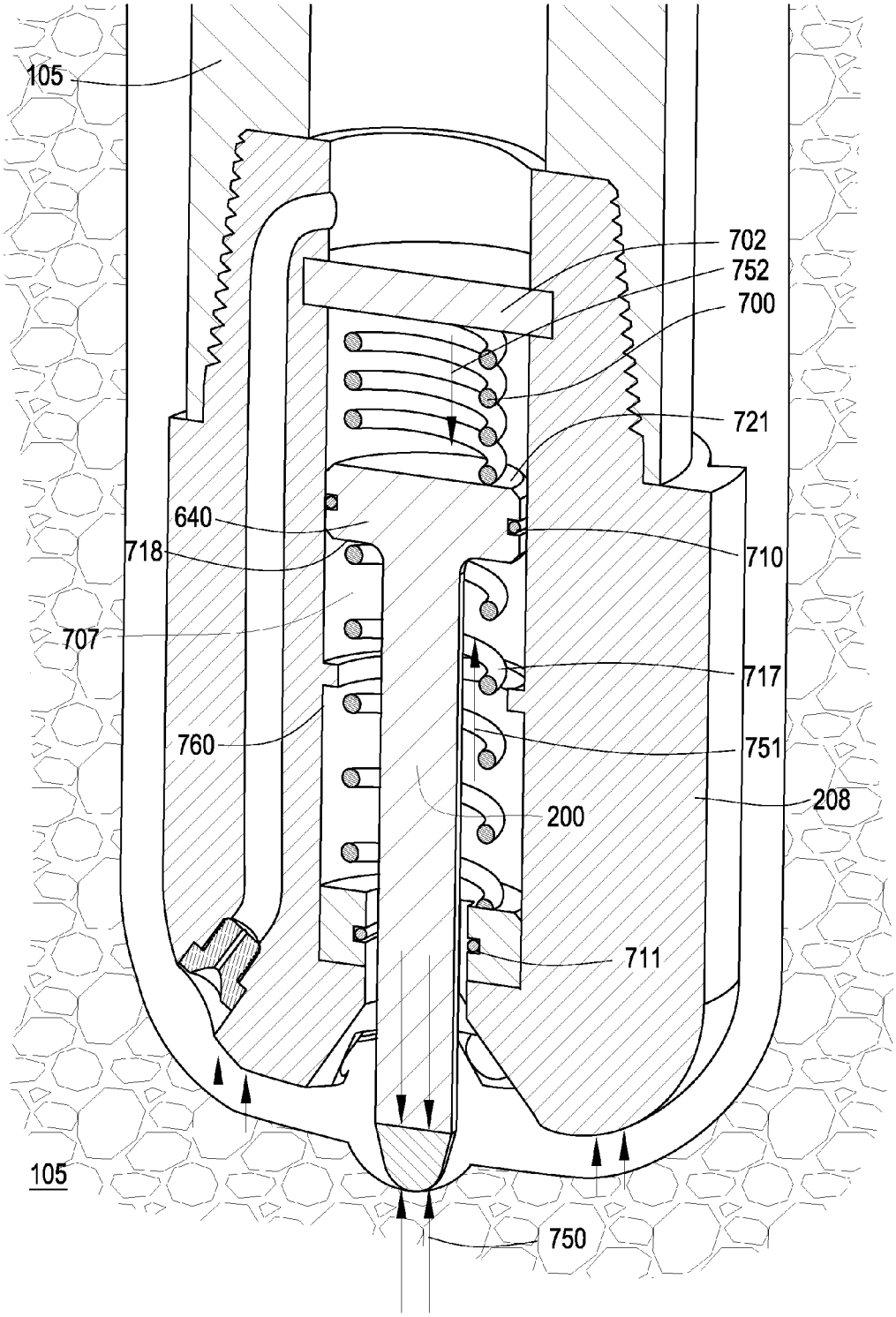
FIG. 7 is another cross-sectional diagram of an embodiment of a drill bit.

FIG. 7 is another cross-sectional diagram of an embodiment of a drill bit. In this embodiment, opposing spring pressures 751, 752 and a formation pressure 750 may determine the position of the hammer 200. A first spring 200 may be generally coaxial with the hammer 200 and disposed with the chamber 707. The first spring 700 may engage the top face 721 of the hammers 200 enlarged portion 740 pushing the hammer against the formation 150. A second spring 717 engages the bottom face 718 of the undercut 640. In this embodiment the first spring 700 transfers the formation pressure to a plate 702, which physically contacts the body portion 208 of the drill bit 104. Spring 700 may absorb shocks or other vibrations that may be induced during drilling. Sealing elements 710 may be intermediate the hammer 200 and the wall 760 of the chamber 707, which may prevent fluid from entering the chamber 707 and corroding the spring 700. Another sealing element 711 may be intermediate the wall 760 of the chamber 707 and hammer 200.

During manufacturing, the chamber may be formed in the body portion 208 with a mill or lathe. In other embodiments, the chamber 707 may also be inserted into the body portion 208 from the shank 209. The hammer 200 may be inserted from the shank 209.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising;

a bit body intermediate a shank and a working face;

the shank being adapted for connection to a drill string;

the drill string comprising a fluid passage at least partially disposed within the body;

a hammer assembly movably disposed within the fluid passage along it central axis;

the hammer assembly comprises a distal end protruding out of the working face and a carrier; and the hammer assembly further comprises a biasing element adapted to urge the distal end of the hammer assembly towards the shank.

2. The drill bit of claim 1, wherein the biasing element is a spring.

3. The drill bit of claim 1, wherein the biasing element comprises a segmented spring.

4. The drill bit of claim 3, wherein the segmented spring comprises intertwined segments.

5. The drill bit of claim 1, wherein the biasing element is in contact with an undercut of the hammer assembly.

6. The drill bit of claim 5, wherein the biasing element is intermediate the undercut and a bottom of a fluid passage.

7. The drill bit of claim 1, wherein the body comprises at least one centralized bearing adapted to stabilize the hammer assembly.

8. The drill bit of claim 1, wherein the distal end comprises a substantially pointed tip adapted to engage a formation.

9. The drill bit of claim 1, wherein the drill bit comprises an upper and lower bearing around a distal and proximal end of the hammer assembly.

10. The drill bit of claim 1, wherein the biasing element is a tension spring engaged with the carrier of the hammer assembly.

11. The drill bit of claim 1, wherein the carrier comprises a fluid relief port.

12. The drill bit of claim 1, wherein the carrier in part forms a knife valve.

13. The drill bit of claim 12, wherein the knife valve is in part formed by a diameter restriction in the fluid passageway.

14. The drill bit of claim 13, wherein the restriction comprises a tapered surface adapted to direct fluid flow towards a center of the fluid passage.

15. The drill bit of claim 13, wherein the restriction comprises an undercut.

16. The drill bit of claim 1, wherein the hammer assembly comprises 0.1 to 0.75 inch stroke.

17. The drill bit of claim 1, wherein the fluid passage comprises a cavity adapted to fit the carrier.

18. The drill bit of claim 1, wherein the hammer assembly weighs 5 to 20 lbs.

19. The drill bit of claim 1, wherein the distal end extends beyond a carbide ring.

20. The drill bit of claim 19, wherein a plurality of cutters is bonded to the carbide ring.

* * * * *